US005230723A

United States Patent [19]

Travis et al.

[11] Patent Number: 5,230,723

[45] Date of Patent: Jul. 27, 1993

[54] PORTABLE FILTRATION UNIT

[75] Inventors: Terrell F. Travis, Alpharetta; David M. Shagott, Duluth, both of Ga.; Gary E. Kruse, Lincoln University, Pa.; Daniel N. Sutherland, Fort Erie; Blair L. Harber, Jr., St. Davids, both of Canada

[73] Assignee: Abatement Technologies, Lawrenceville, Ga.

[21] Appl. No.: 766,000

[22] Filed: Sep. 26, 1991

Related U.S. Application Data

[63] Continuation-in-part of Ser. No. 613,212, Nov. 14, 1990, Pat. No. 5,069,691.

[51] Int. Cl.[5] ..... B01D 46/00

[52] U.S. Cl. ..... 55/350; 55/274; 55/356; 55/323; 55/124; 55/126; 55/472; 55/482; 55/483

[58] Field of Search ..... 55/323, 482, 484, 274, 55/350, 356, 467, 472, 483, 124, 126

[56] References Cited

U.S. PATENT DOCUMENTS

| | | | |
|---|---|---|---|
| 324,575 | 8/1885 | Mertscheimer et al. | 55/465 |
| 925,626 | 6/1909 | Dion | 55/124 |
| 2,295,984 | 9/1942 | Wilson | 55/472 |
| 2,927,659 | 3/1960 | Pabst et al. | 55/283 |
| 3,012,762 | 12/1961 | Norris | 257/295 |
| 3,053,700 | 9/1962 | Kulp | 134/10 |
| 3,172,747 | 3/1965 | Nodolf | 55/124 |
| 3,247,652 | 4/1966 | Annas et al. | 55/483 |
| 3,308,609 | 3/1967 | McCulloch et al. | 55/472 |
| 3,375,400 | 4/1968 | Pelosi, Jr. | 55/276 |
| 3,547,085 | 12/1970 | Kovacik et al. | 55/465 |
| 3,802,168 | 4/1974 | Deckas | 55/473 |
| 3,804,942 | 4/1974 | Kato et al. | 423/239 |
| 3,812,370 | 5/1974 | LaViolette | 250/527 |
| 3,828,530 | 8/1974 | Peters | 55/473 |
| 3,926,596 | 12/1975 | Coleman | 55/304 |
| 3,960,527 | 6/1976 | Goettl | 55/269 |
| 4,017,281 | 4/1977 | Johnstone | 55/334 |
| 4,261,712 | 4/1981 | Kinkade | 55/126 |
| 4,306,893 | 12/1981 | Fernando et al. | 55/302 |
| 4,590,884 | 5/1986 | Kreeger et al. | 118/308 |
| 4,591,368 | 5/1986 | MacDuff | 55/372 |
| 4,630,530 | 12/1986 | Eckstrom | 55/126 |
| 4,737,173 | 4/1988 | Kudirka et al. | 55/276 |
| 4,787,922 | 11/1988 | Kulitz | 55/482 |
| 4,935,984 | 6/1990 | Bryant et al. | 15/302 |
| 4,968,333 | 11/1990 | Ellis et al. | 55/341 |
| 5,069,691 | 12/1991 | Travis et al. | 55/482 |
| 5,102,435 | 4/1992 | Rau et al. | 55/467 |

FOREIGN PATENT DOCUMENTS

| | | | |
|---|---|---|---|
| 2459356 | 6/1975 | Fed. Rep. of Germany . | |
| 156517 | 9/1982 | German Democratic Rep. . | |
| 53-83171 | 7/1978 | Japan | 55/316 |

OTHER PUBLICATIONS

Aercology, Inc. Brochure "Modular Media Filter" (May 1989) (Exhibits 13 and 14).

Aercology Air Cleaning Systems Advertisement, "Ugly Air" (Dec. 1988) (Exhibit 16).

Aercology Air Cleaning Systems Advertisement, (Feb. 1989) (Exhibit 17).

Certificate of Registration and Specimen for U.S. Trademark Registration No. 1,481,524 (filed Jan. 7, 1987).

(List continued on next page.)

*Primary Examiner*—Bernard Nozick

*Attorney, Agent, or Firm*—Kilpatrick & Cody

[57] ABSTRACT

A portable vacuum and air filtration unit, comprising: a plurality of separately transportable modules and a means for locking the modules together during use, an air inlet located in one of the modules, a debris screen and a means for receiving debris stopped by the screen located in one of the modules, an electrostatic filter located in one of the modules of some embodiments of the invention, a bag filter assembly located in one of the modules, a HEPA filter assembly located in one of the modules, and a means for drawing a substantial volume of air through the inlet, screen, electrostatic filter, bag filter assembly and HEPA filter assembly.

6 Claims, 8 Drawing Sheets

OTHER PUBLICATIONS

Advertisement for Omniforce 77 Air Filtration System, purported by the reexamination requester to be from *Econ* magazine, Jul. 1989.

Advertisement for Omniforce Filtration System, purported by the reexamination requester to be from *Econ* magazine, Sep. 1989.

Advertisement for Omniforce Air Filtration System, purported by the reexamination requester to be from *Asbestos Issues* magazine, Dec. 1989.

Advertisement for Red Baron, purported by the reexamination requester to be from *Econ* magazine, Apr. 1988.

Advertisement for Sentry, purported by the reexamination requester to be from *Asbestos Abatement* magazine, Jul./Aug. 1989.

Advertisement for Blue Max from *Asbestos Issues* magazine, Aug. 1989.

Brochure for Aqualine Resources, Inc. entitled "Master Vac" dated Nov. 1990.

Brochure for Health Aire Company, Inc. entitled "PV4000" dated Oct. 25, 1990.

Advertisment and brochure for Vac Systems Industries dated Oct. 1990.

Brochures for Pringle Co. entitled "Power-Vac" dated Jul. 1990.

Brochure for U.S. Industrial Company's OMNI/H-VAC Duct Cleaning System dated Feb. 1991.

Advertisement and brochure for "Vent Vac" Duct Vacuum dated Jan. 1991.

Advertisement and brochure entitled "Mechaniclean" Duct Cleaner System dated Jan. 1991.

Advertisement entitled "Mac Attach,", DucTales, vol. 3, No. 6, Nov. 191.

Advertisement entitled "Go With the Flow,"0 DucTales, vol. 3, No. 6, Nov. 1991.

PORTABLE FILTRATION UNIT

This application is a continuation in part of co-pending U.S. Pat. application Ser. No. 07/613,212 (now U.S. Pat. No. 5,069,691), filed Nov. 14, 1990, having the same title.

BACKGROUND OF THE INVENTION

The present invention relates to portable filtration units for cleaning heating, ventilation, and air conditioning ("HVAC") ductwork in residential and commercial buildings. Such cleaning is often needed, particularly in older buildings, to remove accumulations of dust, dirt, and other debris that collect in the ductwork and can cause allergic reactions or pose other health and safety risks.

Generally, HVAC duct cleaning has been accomplished using large, truck-mounted vacuum units. These vacuum units are driven by a power takeoff from the truck engine and typically generate air flow of 10,000 to 20,000 cubic feet per minute ("CFM") at the truck. Of course, the truck must normally be parked outside a convenient doorway into the building, and the building ductwork is connected to the truck mounted vacuum unit by a long, flexible, temporary duct or hose. Because of losses in the flexible duct, the airflow generated at the input end of the flexible duct typically drops significantly to around 5000 to 8000 CFM or less.

In use, once the vacuum unit is connected to the building ductwork, a wand or "skipper" is inserted into and passed through the building ductwork. The skipper is connected to an air compressor and has a head with multiple air jets. Compressed air forced through the skipper air jets and directed toward the vacuum unit loosens, agitates and suspends in the air dirt and dust in the ductwork and blows other debris toward the vacuum unit. The suction generated by the vacuum unit pulls the suspended dirt, dust and debris into the truck and blows it through cloth bag filters, which typically trap only 40% to 60% of the dirt and dust before the remainder is exhausted with the air into the atmosphere. Cleaning all the ducts in the building can take 2 to 3 hours in a typical residence and longer in a commercial building.

There are several disadvantages associated with truck-mounted vacuum filtration units. First, such units are expensive to purchase and to operate. For example, truck mounted units require a two person crew to use. Further, because of the length of the temporary duct, truck mounted units require 1 to 2 hours to set up. Therefore, a typical crew can only clean two buildings in one day. In addition, because the vacuum unit is powered by the truck's engine, the truck must be left running during the entire cleaning operation, not only using a large quantity of gasoline or diesel fuel which the vacuum unit operator must supply, but also increasing the maintenance requirements of the truck. Finally, from the building owner's perspective, truck mounted units are exhausting 5000 to 8000 CFM of air conditioned o heated air into the atmosphere for 2 to 3 hours, which can have a large impact on the owner's utility bill.

A more important disadvantage with truck mounted vacuum units is the dust and dirt the units exhaust. With filters that are at best 40% to 60% efficient, truck-mounted vacuum units spew out large amounts of dust or dirt, most of which settles back on the building being cleaned. The filters used on these truck-mounted units are particularly ineffective (less than 10% efficient) at filtering the small, invisible particles of 10 microns or less in diameter that are often the most harmful to humans. When this dust or dirt also contains asbestos fibers (a not unusual occurrence in older buildings), or worse—pathogens like legionella or other disease causing materials—the filth sprayed about by truck mounted vacuum units can be a health risk, particularly for the operator, if not an environmental hazard.

A third disadvantage to truck mounted units is that the unit must remain outside the building, and because of losses in the flexible duct, the duct can be of only limited length. Thus, although usable for residential and low rise commercial buildings, truck mounted vacuum units cannot be used on buildings more that a few stories tall.

Finally, truck mounted vacuum units are noisy. Although the noise generated by these units may not be intrusive in an busy urban setting, the deafening roar and whine generated by truck mounted units can be intolerable on the quiet suburban residential streets where the units are typically employed.

Some of the described problems are answered by prior art portable filtration units. Currently, there are several vacuum filtration units on the market that are intended to be portable. Some of these units are operated by a gasoline engine and have many of the drawbacks discussed above, such as noise, expense, and the requirement of operation outside the building. There are prior portable units that are operated by electric motors; however, until the present invention, none of these units have been entirely satisfactory.

For example, one such unit is powered by a 3 horsepower electric motor and weighs less than 200 pounds. However, the electric motor of this unit requires 230 volt electric service and draws 18 amperes. Many residential or light commercial building contain no provision for 230 volt electric service in the locations where the vacuum unit must be operated. Furthermore, the airflow generated by this unit is less than 2000 CFM, which is insufficient to thoroughly clean HVAC ductwork. Finally, most important, this unit also uses inefficient cloth filtration bags, which results in most of the dust and dirt collected by the unit being exhausted back into the building being cleaned or adjoining buildings.

A second electric unit currently on the market is powered by two 5 horsepower 208/230 volt electric motors, which are also unsuitable for residential and light commercial buildings. Furthermore, the unit has two parts; one weighs 150 pounds, and the other weighs 350 pounds. The weight of this unit reduces its portability and requires a two person crew. This unit does generate an airflow of 4000 to 5000 CFM and the filtering system includes a high efficiency particulate air ("HEPA") filter.

A third unit currently on the market includes a HEPA filter, runs on 110 volts, and is of a modular design. However, the electric motors on this unit draw 70 amperes, and render the unit virtually unusable in residential or light commercial buildings where the typical electric circuit is 15 amperes.

SUMMARY OF THE INVNETION

The present invention solves the problems of the prior art in a portable filtration unit that contains up to four separate, easily maintained filters; a large particle filter, a cleanable and reusable electrostatic filter, a bag filter, and a HEPA filter. This cascade of filters exhausts almost totally clean air while successfully dealing with the astoundingly wide range of debris found in HVAC ductwork. The unit is powered by one or multiple 110 volt electric motors, each drawing less than 15 amperes The blowers attached to the embodiments containing multiple electric motors generate a total airflow of at least 4000 CFM. The filtration unit is of wheel-mounted, modular design, with the motors, blowers and filters housed in separate, easily connected compartments. The unit is easily transported to the HVAC system to be cleaned and can be quickly set up by a single person. Other embodiments of the invention contain modules sufficiently small to permit the modular structure to pass through typical residential doorways without resistance.

Accordingly, one objective of the present invention is to provide an inexpensive filtration unit.

Another objective of the present invention is to provide a portable filtration unit.

A further objective of the present invention is to provide a filtration unit that can be easily transported and set up by a single person.

Still another objective of the present invention is to provide a filtration unit which is suitable for use in high rise commercial buildings.

Still another objective of the present invention is to provide a filtration unit that operates on standard household electric current.

A further objective of the present invention is to provide a filtration unit which contains a HEPA filter.

Still another objective of the present invention is to provide a filtration unit that is modular.

A further objective of the present invention is to provide a filtration unit in which filter life is maximized and operating costs minimized.

Still another objective of the present invention is to provide a filtration unit which provides a deflector baffle which will prevent objects drawn into the unit from being propelled through the unit thereby damaging the filters.

These and other objectives and advantages of the present invention will become apparent from the detailed description and claims which follow.

DETAILED DESCRIPTION OF THE DRAWINGS

Figure 1:
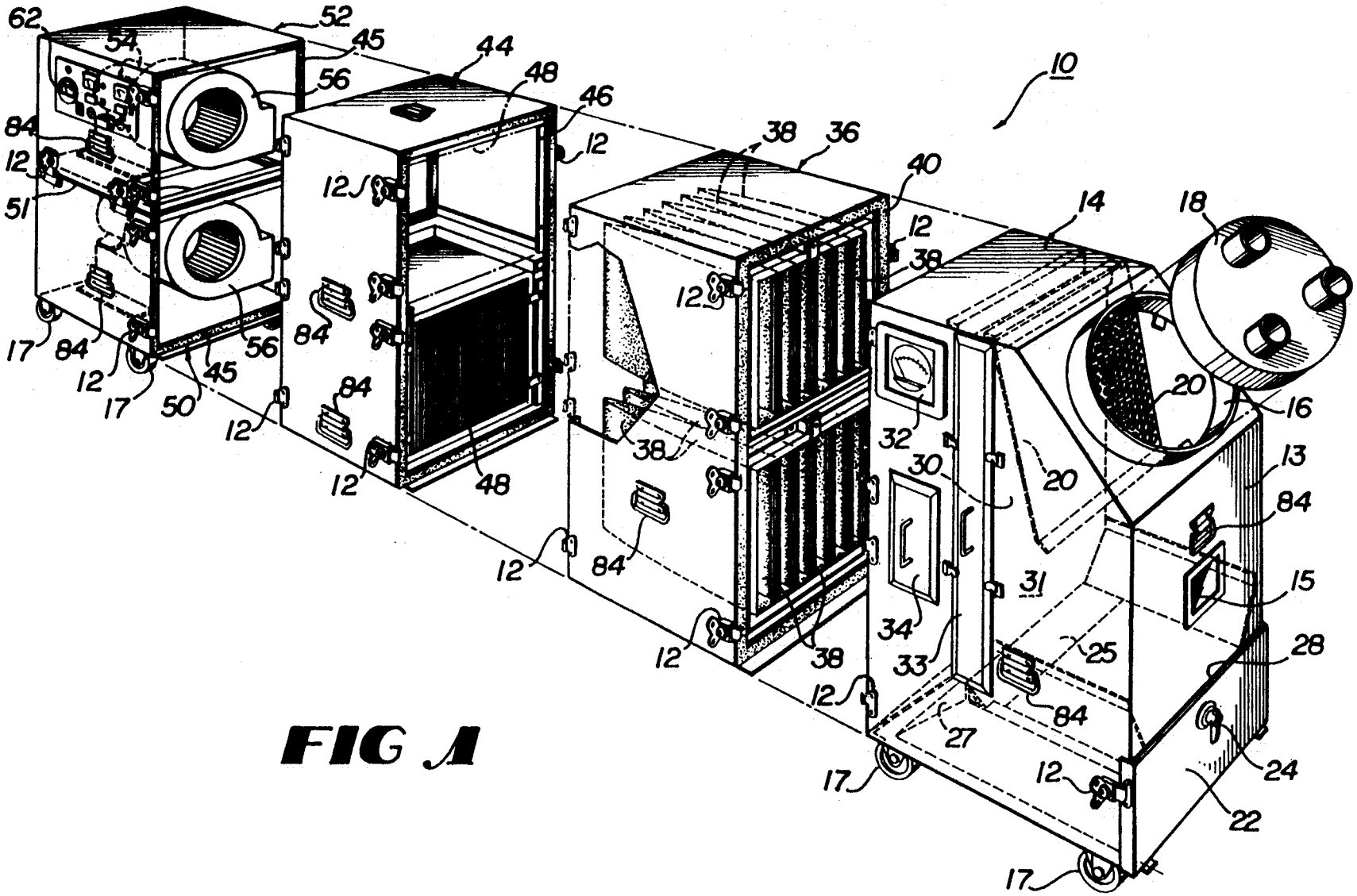
FIG. 1 is an exploded perspective view of one embodiment of the present invention.
Figure 2:
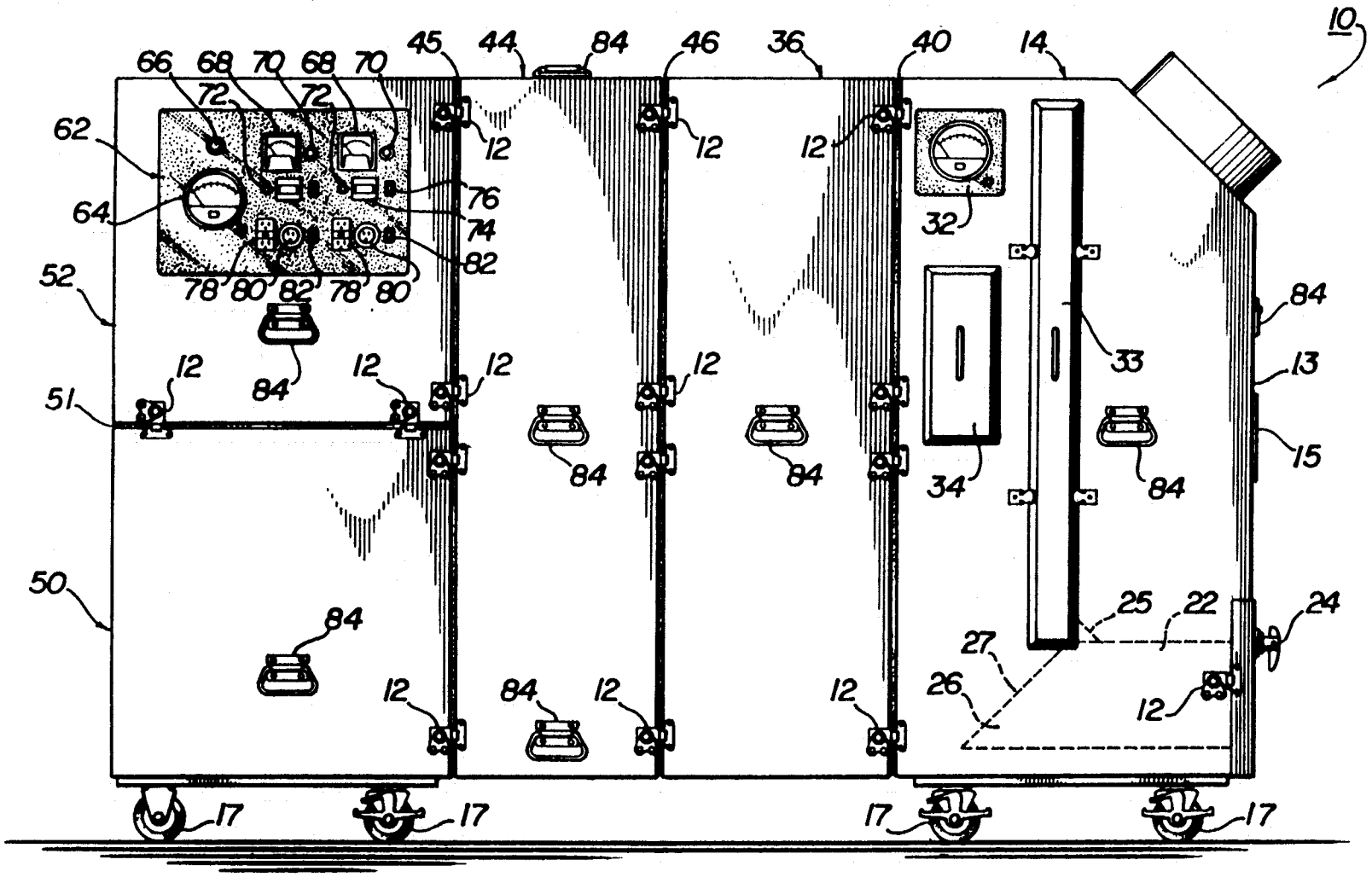
FIG. 2 is an elevation of the embodiment of the present invention shown in FIG. 1.
Figure 3:
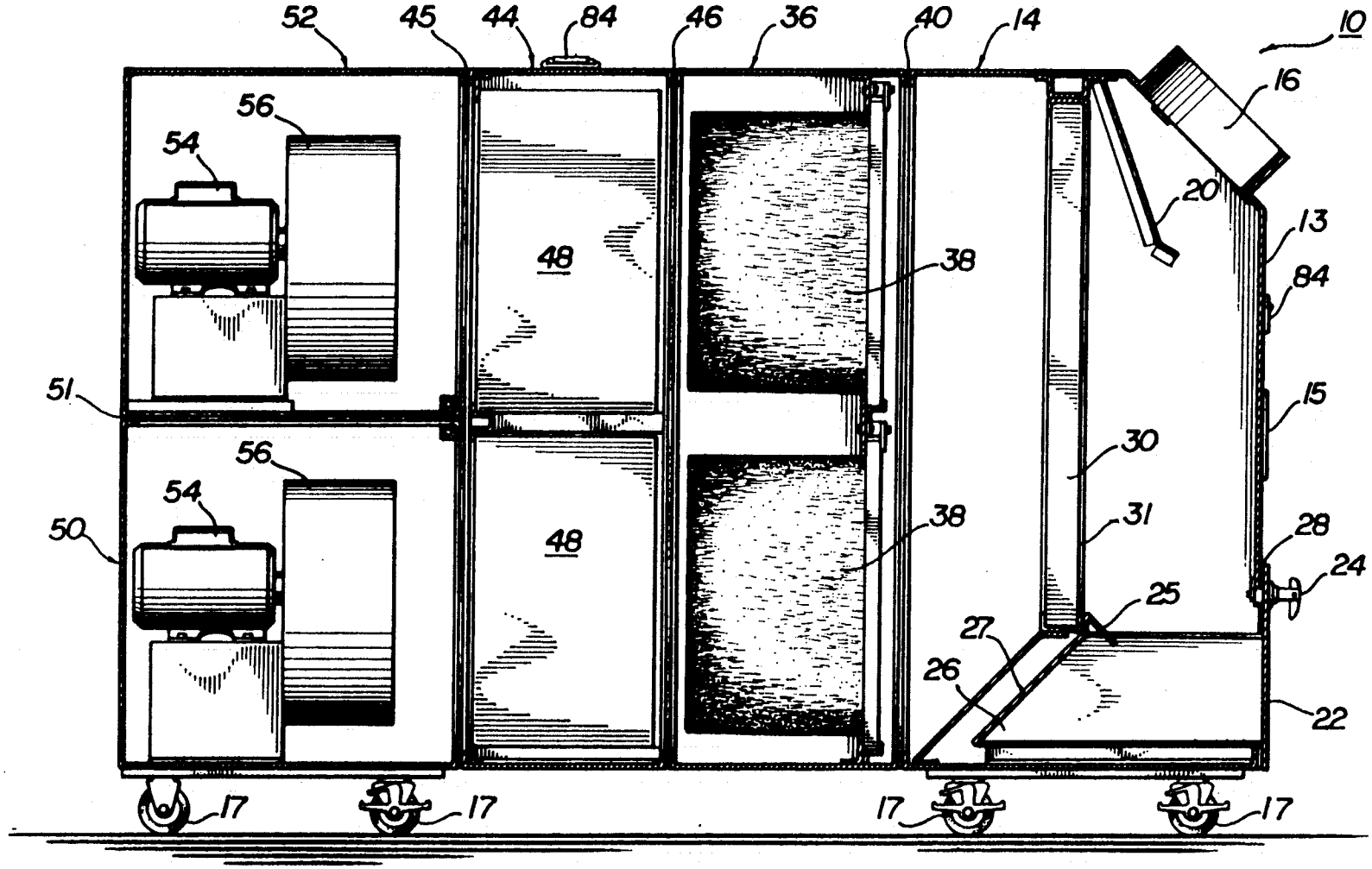
FIG. 3 is a longitudinal cross section taken substantially through the center of the unit shown in FIGS. 1 and 2.
Figure 4:
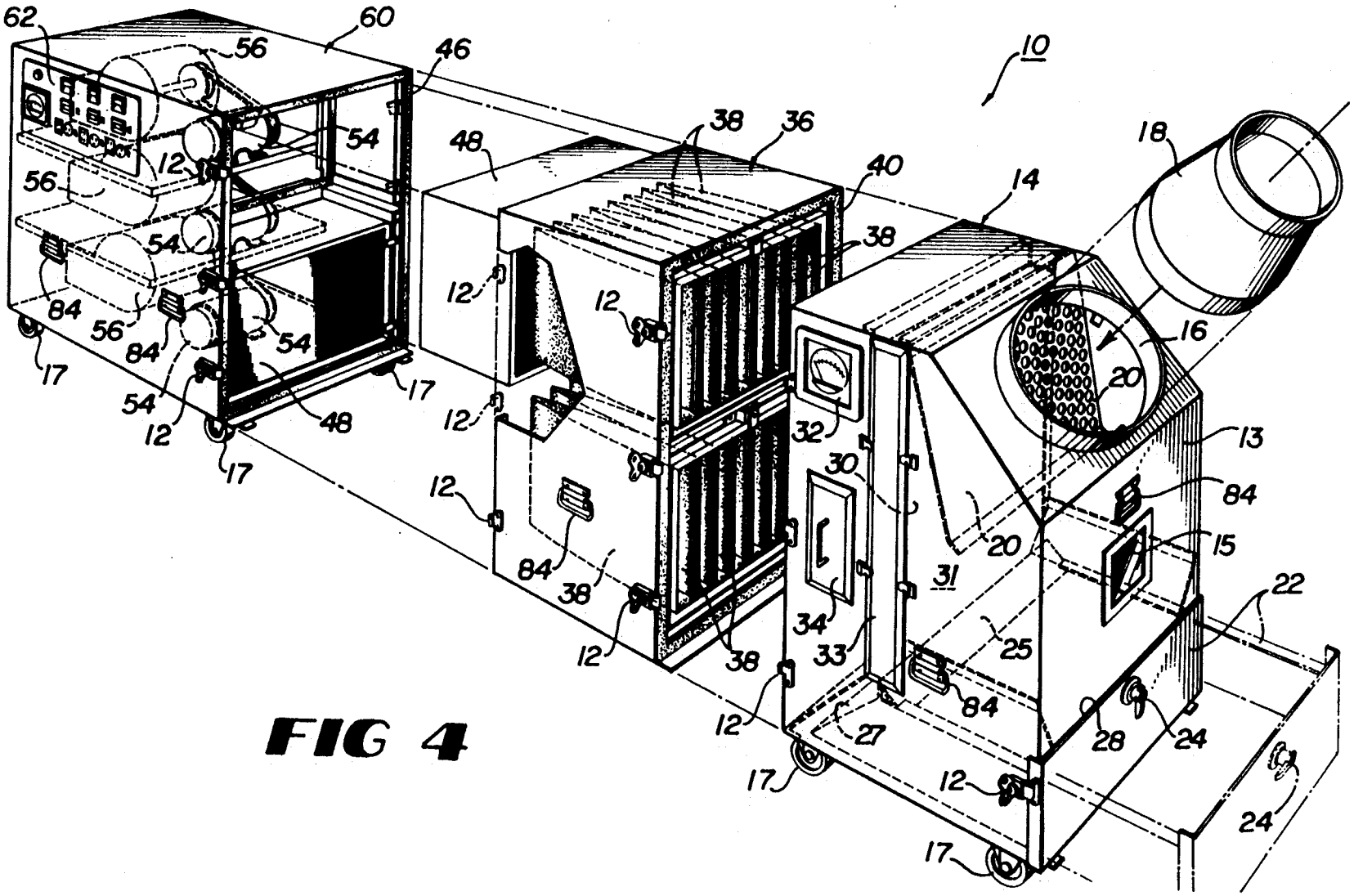
FIG. 4 is an exploded perspective view of a second embodiment of the present invention.

As can be seen in FIGS. 1, 2, 3, 4, 5, and 6, the filtration unit 10 has several chest-like modules which are easily maneuvered using carrying handles 84 and are connected for use by cam locks 12. The first inlet module 14 and all other sheet components of unit 10, except as otherwise noted, are preferably made of steel, stainless steel, aluminum, or aluminum alloy. Inlet module 14 includes an air inlet 16, which is preferably at a 45° angle and to which duct connector 18 is attached, rests on castors 17 which swivel 360° and can be locked, and is moved using carrying handles 84. Duct connector 18 is preferably made of steel, stainless steel, aluminum, or aluminum alloy, but other suitable materials may be used. Duct connector 18 may be straight or angled (not shown) and join a single duct inlet 16 as shown in FIG. 4 or, as shown in FIG. 1, may join multiple smaller ducts to inlet 16 for multiple vacuum inlets.

Inlet module 14 also contains particulate deflector 20, a perforated sturdy sheet positioned in the incoming airstream to deflect large debris entering inlet module 14 through inlet 16 into collection drawer 22. Drawer 22 is preferably made of steel, stainless steel, aluminum, or aluminum alloy and as can be seen in FIGS. 1 and 4, can be easily removed from inlet module 14 by pulling on locking handle 24. As can be seen in FIGS. 1, 2, 4, and 5, the rear 26 of drawer 22 forms two V-shaped areas 25 and 27 that trap particles, thereby allowing any particles entering drawer 22 to precipitate to the bottom of drawer 22 and remain there despite the turbulence above drawer 22 created by air entering inlet module 14 through inlet 16. Drawer 22 also contains a gasket 28 which in combination with locking handle 24, seals drawer 22 against front 13 of inlet module 14. Deflector 20 in combination with drawer 22 minimizes premature loading on filter 30 and bag filter 38, thereby maximizing filter life and airflow and reducing filter replacement costs.

Figure 5:
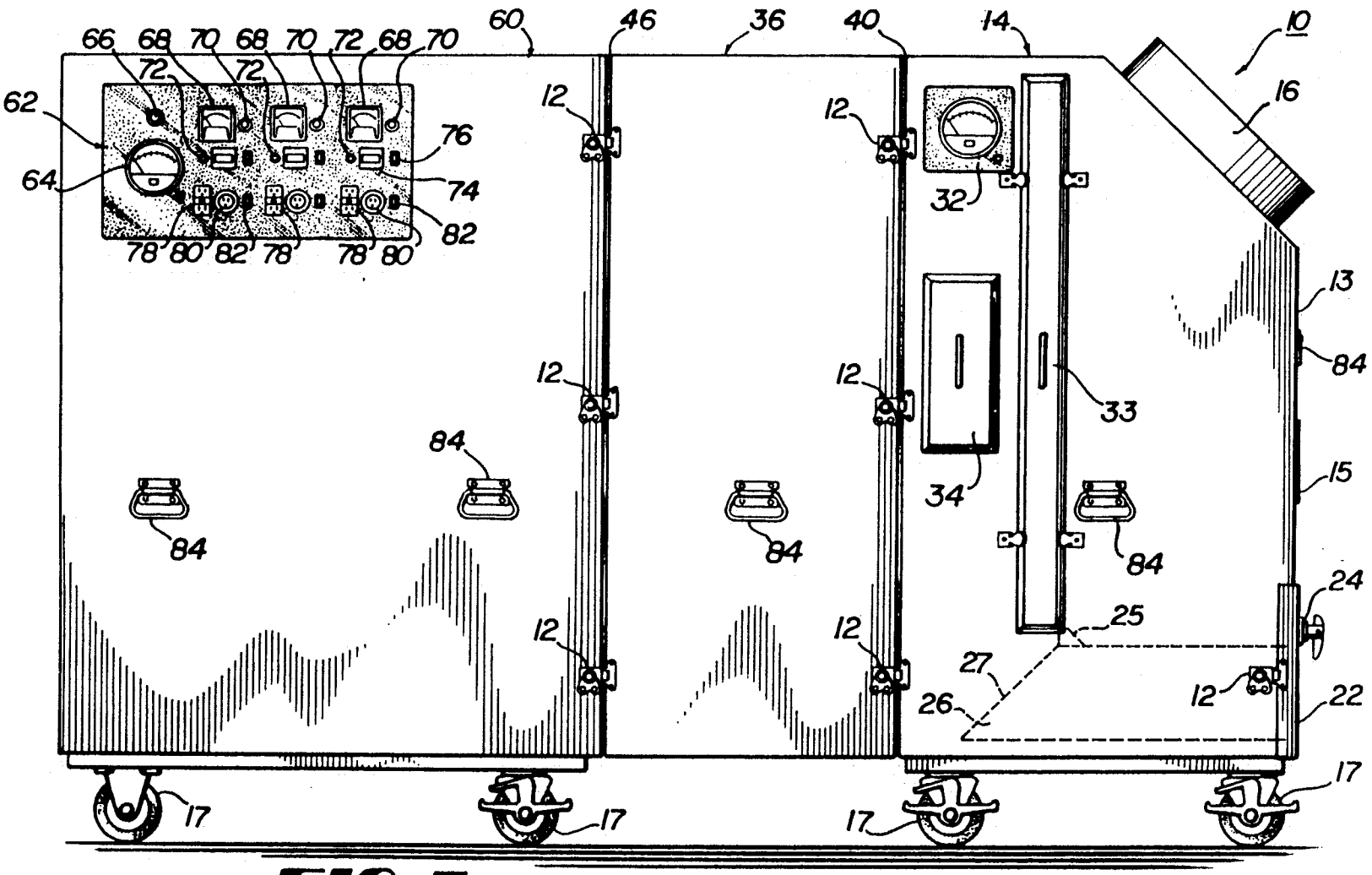
FIG. 5 is an elevation of the second embodiment of the present invention of FIG. 4.

Air entering inlet module 14 passes from the large debris-trapping chamber 11 through electrostatic prefilter 30. Electrostatic filters of the type used in unit 10 are well-known in the art and are available from companies like Air Purification of Houston. Filter 30 is accessible through filter door 33. In the event filter 30 becomes clogged, as shown by a rise in pressure differential on magnahelic gauge 32, access door 34 can be removed and filter 30 tapped or vibrated to loosen the dirt, dust, or other debris that has accumulated on the upstream side 31 of filter 30. Access door 34 is then reinstalled on inlet module 14. As can be seen in FIGS. 3 and 5, the debris so loosened from filter 30 falls into drawer 22. The condition of filter 30 can also be monitored through plexiglass window 15.

The screened and prefiltered air that has passed through filter 30 then enters bag filter module 36, which is of similar chest-like construction and attaches to inlet module 14 by cam locks 12 and is sealed by gasket 40. Bag filter module 36 contains fiberglass cloth bag filters 38. Such filters 38 are well-known in the art and are available, for instance, from Cambridge Filter Corporation. Air passing into second module 36 flows through filters 38 and exits bag filter module 36.

As can be seen in FIGS. 1, 2, and 3, in one embodiment of the present invention, the screened and filtered air exiting bag filter module 36 enters HEPA filter module 44, which is of like construction to bag filter module 36, is attached to bag filter module 36 by cam locks 12, and is sealed against bag filter module 36 by gasket 46. HEPA filter module 44 contains high efficiency particulate air ("HEPA") filters 48, which filters are also well-known in the art. Similar HEPA filters may be obtained from Cambridge Filter Corporation. Air entering HEPA filter module 44 passes through HEPA filters 48, which filter out 99.97% of the dust and dirt particles 0.3 microns or larger in size suspended in the air, and enters fan modules 50 and 52.

Fan modules 50 and 52, which are of similar construction to inlet module 14, bag filter module 36 and HEPA filter module 44, each contain an electric motor 54, which drives a centrifugal fan blower 56. Fan modules 50 and 52, attach to each other and HEPA filter module 44 by cam locks 12, and are sealed by gaskets 45 and 51. Although the embodiment shown in FIGS. 1, 2, and 3 uses two motors 54 and two blowers 56, fewer or more motors 54 and blowers 56 can be used in sizes and configurations dictated by the air handling capacity desired. Each motor 54 should preferably run on standard 120 volt household current and draw no more than 15 amperes. A sufficient number of pairs of motor 54 and blower 56 are used to generate an airflow of at least 3500 CFM, with 4000 CFM to 6000 CFM being preferred. Fan module 52 also contains control panel 62, which controls both fan module 52 and fan module 50. Control panel 62 contains magnahelic gauge 64, which is used to monitor the airflow resistance through the entire system as duct contaminates load the filters and reduce airflow. Power loss alarms 66 sound if power is interrupted to that circuit (thereby stopping motor 54 and reducing the airflow below optimum). Amperage gauges 68 monitor the current drawn by motors 54 and blowers 56 and allow the operator to monitor each motor 54 and blower 56 pair individually, while power indicators 70 allow the operator to visually determine which motors 54 are operating, even when the operator is not standing next to the unit 10. For safety, circuit breakers 72 and power switches 76 are also provided. Hour meters 74 allow the unit owner to monitor how long each motor 54 of unit 10 has been operated. Control panel 62 also contains ground fault interrupter outlets 78 for us by the operator for accessory equipment and which also protects motors 54 from internal short circuits. Alarm bypasses 82 can be used to disengage power loss alarms 66 when desired. Unit 10 is supplied power through power connectors 80. Each motor 54 has its own power connector 80, allowing each motor 54 of unit 10 to be connected to separate 15 ampere electrical circuits. Fan modules 50 and 52 may also contain an electric limit switch (not shown) which automatically disengages power to motors 54 in the event either fan modules 50 or 52 are disconnected from each other or HEPA filter module 44. Virtually clean air entering fan modules 50 and 52 is exhausted out a baffled exhaust port (not shown) located o the side of fan modules 50 and 52 opposite control panels 62. The exhaust port (not shown) also has a door (not shown) which prevents air from entering the exhaust port in the event both motor 54 and blower 56 pairs are not operated simultaneously.

Figure 6:
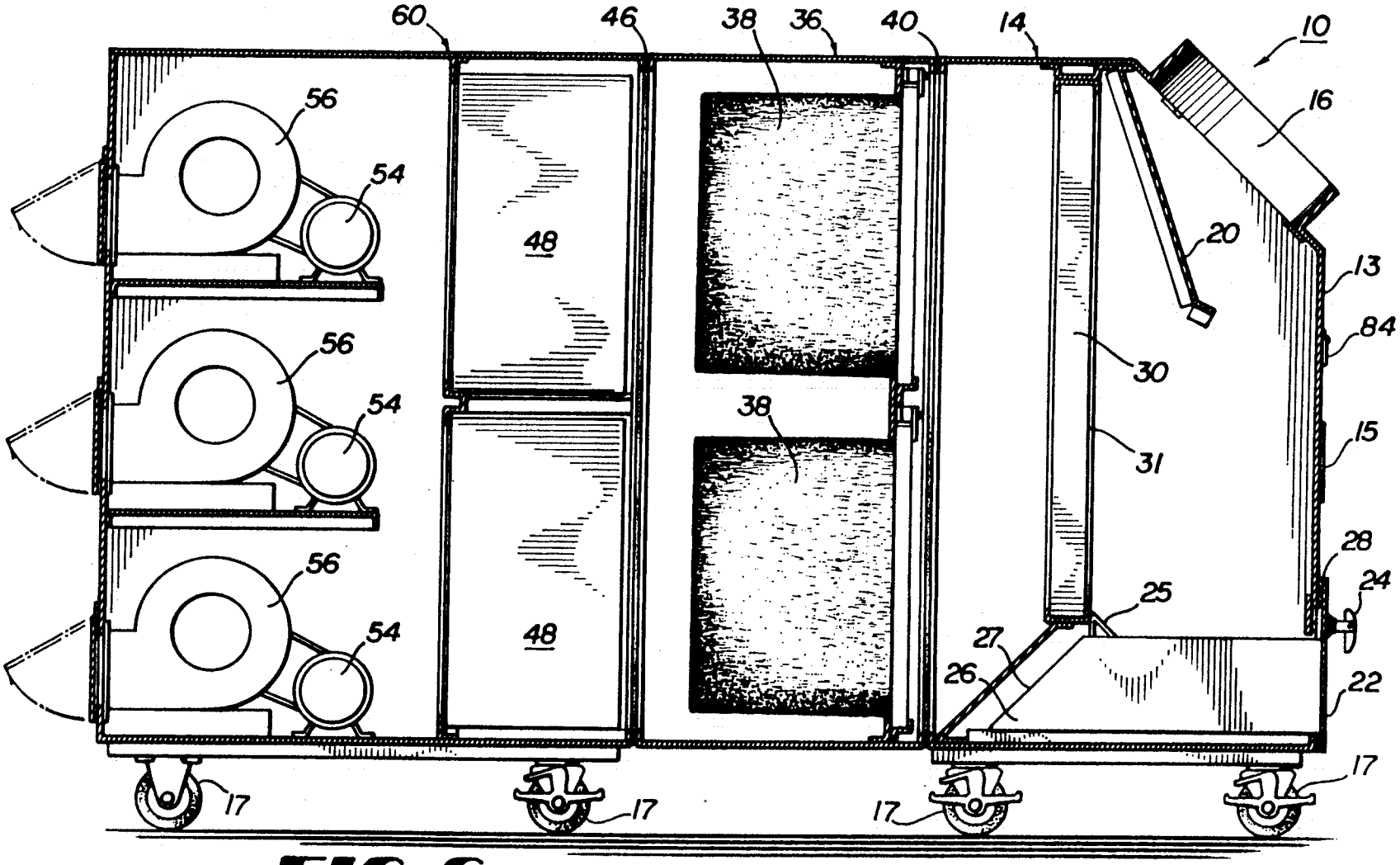
FIG. 6 is a longitudinal cross section taken substantially through the center of the unit shown in FIGS. 4 and 5.

A second embodiment of the present invention is shown in FIGS. 4, 5 and 6. In the second embodiment, screened and filtered air passing through filters 38 and exiting bag filter module 36 enters fan/HEPA module 60. Fan/HEPA module 60 contains HEPA filters 48, three pairs of motors 54 and blowers 56, castors 17, carrying handles 84, and control panel 62. Like fan modules 50 and 52, virtually clean air passing through HEPA filters 48 is exhausted out baffled exhaust ports (not shown) having doors (not shown).

Figure 7:
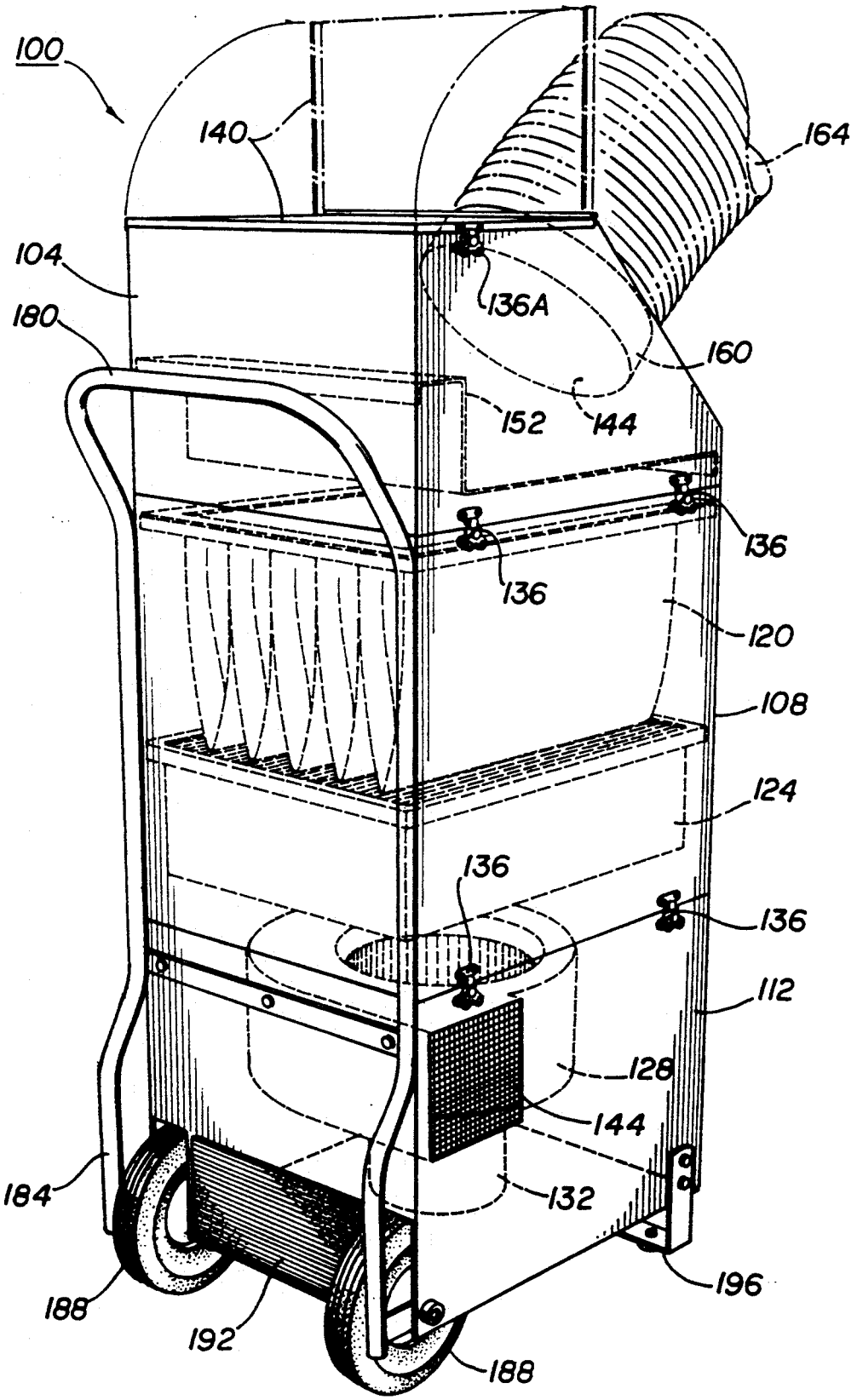
FIG. 7 is a perspective view of another embodiment of a portable filtration unit of the present invention.
Figure 8:
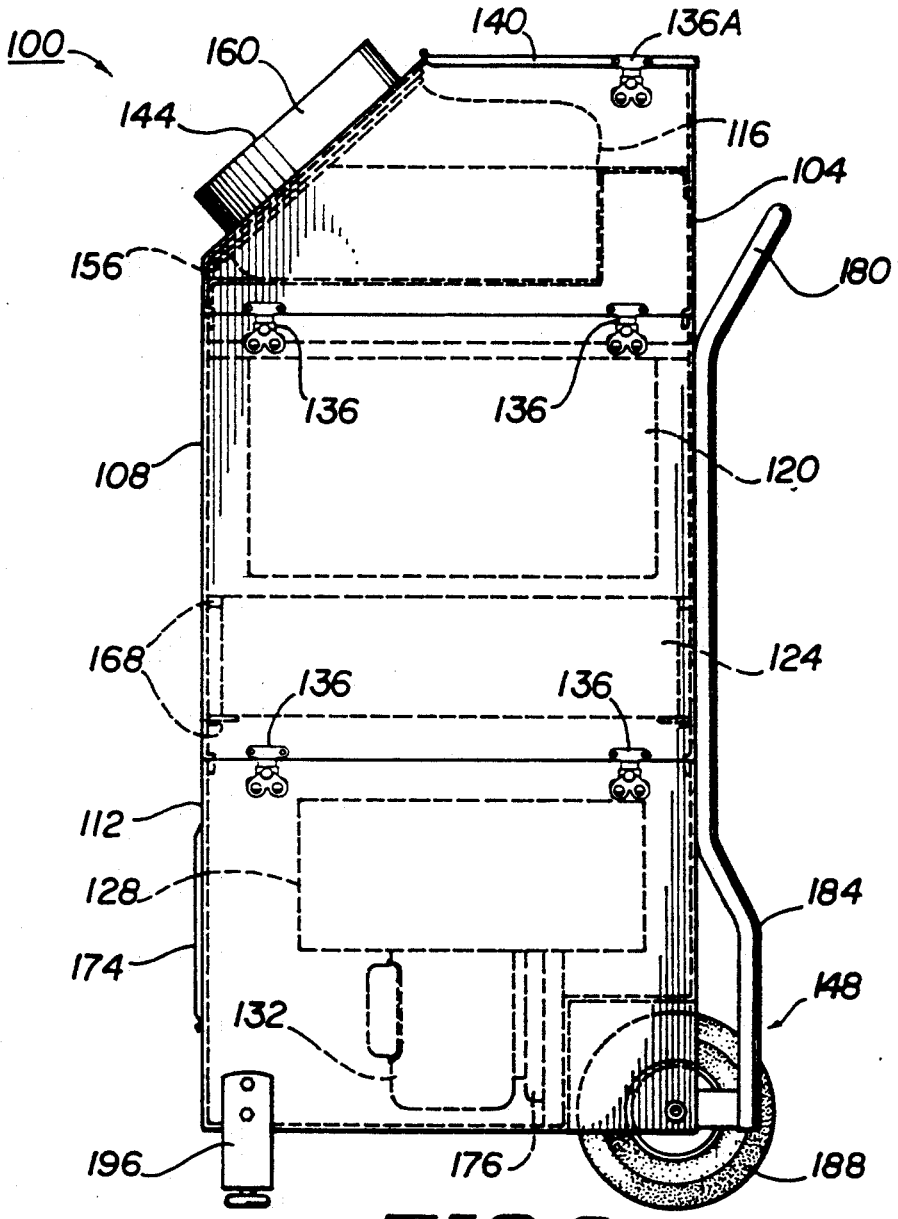
FIG. 8 is a side elevational view of the unit of FIG.

FIGS. 7–8 illustrate portable filtration unit 100 forming another alternate embodiment of the present invention. Filtration unit 100 includes a series of attachable, communicating modules 104, 108, and 112, which can be oriented vertically (stacked) as shown in FIGS. 7–8, horizontally (side-by-side), or, if desired and suitable support means are available, at any selected angle therebetween. Like those of unit 10, the modules 104, 108, and 112 of filtration unit 100 house, respectively, bulk particulate deflector or container 116, bag filter 120, HEPA filter 124, and blower 128 with its associated motor 132. Fluid communication between module pairs 104/108 and 108/112 is facilltated by clip assemblies 136, which function to lock (and, with interconnecting channels in the modules not shown in FIGS. 7–8, seal) the module pairs together while filtration unit 10 is in use. Clip assembly 136A, by contrast, maintains door 140 to module 104 in the closed position when necessary or desired.

In use, air is drawn by blower 128 into module 104 through inlet 144 and travels, respectively, through particulate container 116, bag filter 120, and HEPA filter 124 before being exhausted through port 144 of blower 128. Filtration unit 100 also includes transport assembly 148 connected to module 112, making the unit 100 fully portable and easily handled by a single person. Attached, one embodiment of modules 104, 108, and 112 forms a filtration unit weighing less than 200 pounds and having dimensions of approximately 61"×25.5"×20.6", sufficiently small to be transported in a service van, station wagon, or minivan and into structures having entrances of size on the order of that of typical residential pedestrian doorways (i.e. approximately 3'×7'). Because unit 100 can operate within a commercial or residential structure, lengthy, external ducting is not needed to connect the unit 100 with additional equipment external to the structure. This, of course, permits operation of filtration unit 100 even in poor weather, and avoids conditioned air from escaping the structure during set-up and operation.

As detailed in FIGS. 7–8 and described above, module 104 includes particulate container 116, door 140, and inlet 144. Container 116, which may be a reusable bulk prefilter bag for filtering and retaining relatively large particles, is designed to rest on a channelled frame or shelf 152 in module 104. Container 116 additionally defines an aperture 156 for sealing to a rim 160 of module 104 (which itself defines inlet 144), precluding air entering unit 100 from avoiding the various filters. Rim 160 also connects to external ducting 164, which in turn conveys air from the HVAC ducts and equipment (e.g. the furnace plenum) being cleaned. Door 140 provides access to the interior of module 104, as when particulate container 116 is being removed or reinserted. In one embodiment of module 104 consistent with FIGS. 7–8, module 104 is approximately 14.1"×25.5"×20.6" and weighs twenty-three pounds. By design, module 104 may be rotated 180° about a (nominally vertical) axis through the filtration unit 100 from the position shown in FIGS. 7–8, permitting differing placement of inlet 144 for fore or aft external ducting 164.

Module 108, which communicates with both modules 104 and 112 while filtration unit 100 is in use, contains filtration means such as bag filter 120 and HEPA filter 124. One embodiment of unit 100 includes an 85% ASHRAE-efficient pleated bag filter as filter 120 and a 99% ASHRAE-efficient (at one micron) HEPA filter as filter 124. Those having ordinary skill in the art will recognize, however, that one or more other filters having sufficient filtering capability may be used to replace either or both of filters 120 and 124. The interior of module 108 also contains means, such as channelled frame 168, for maintaining filters 120 and 124 in place and preventing air from circulating around, rather than through, the filters 120 and 124. One embodiment of module 108 weighs approximately forty-nine pounds and is 24" in height.

Figure 9:
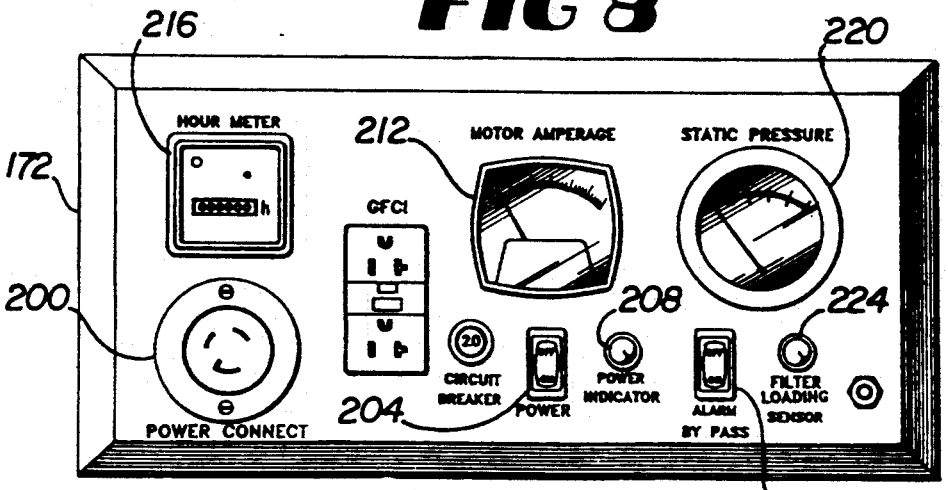
FIG. 9 is a front elevational view of a control panel used in connection with the unit of FIG. 7

Included as part of (or connected to) module 112 are blower 128, motor 132, transport assembly 148, and control panel 172 (FIG. 9) having cover 174. For many duct-cleaning applications blower 128, which may be a centrifugal fan, is designed to pull at least 2600 CFM of air while operating at a noise level of approximately 77 dBA, sufficiently quiet for in-home residential or similar use. Associated motor 132 may be a 13 A, 1.5 hp motor designed to operate using standard household voltage (110/120 V) and current (less than 15 A). By utilizng household voltage, no inconvenient (e.g. 220 V) or potentially more dangerous (e.g. LP gas) installation is required. Blower 128 and motor 132, furthermore, are mounted within module 112 using mounting 176, which permits stable operation of unit 100 in a variety of orientations without undue blower 128 vibration or stress. Including transport assembly 148, module 112 weighs approximately 119 pounds and is less than approximately 19" in height.

Transport assembly 148, in turn, comprises handle 180 with integrally-formed rails 184, wheels 188, kick plate 192, and pedestal 196. Handle 180 facilitates transport of unit 100 by a single worker, while also serving as a loading ramp assembly lever and a stabilizer when the unit 100 is oriented horizontally. Rails 184 facilitate conveyance of filtration unit 100 up or down stairs, while recessed wheels 188 likewise aide movement of the unit 100. Pedestal 196, finally, functions both to support unit 100 in the vertical position and as a handle when module 112 is loaded or unloaded from transport vehicles.

At any time after modules 104, 108, and 112 are assembled and external ducting 164 connected as appropriate, operation of filtration unit 100 may begin. Suitable cable may be used to couple the household voltage supply to receptacle 200 on control panel 172 and power switch 204 depressed to activate motor 132 and illuminate power indicator 208. Amperage gauge 212 monitors current used by unit 100, while hour meter 216 times the operation of motor 132. The static pressure gauge 220 on panel 172 indicates the total system pressure loss due to various air flow restrictions including the loading of particulate container 116 and filters 120 and 124 with duct contaminants. Filter sensor 224 provides visual and audible indication of substantial air flow loss, although the audible alarm may be bypassed by depressing switch 228.

Although modules 104, 108, and 112 are illustrated in FIGS. 7-8 as being attached, they are easily detached merely by disengaging clip assemblies 136 and unstacking. Detaching the modules 104, 108, and 112 may in some cases facilitate replacement of, for example, filters 120 and 124, or assist transport under certain conditions. In their unattached states, modules 104, 108, and 112 may be provided with cover plates for sealing the interiors and protecting their contents from the environment and vice-versa. Moreover, although FIGS. 7-8 show only a single filtration unit 100, multiple units may operate concurrently within a structure and, if appropriately adapted, cooperatively to create greater vacuum strength should it be desired.

This description is provided for illustration and explanation. It will be apparent to those skilled in the relevant art that modifications and changes may be made to the invention as described above without departing from its scope and spirit.

We claim:

1. A portable filtration unit comprising:
   a. a prefilter modular housing defining a fluid inlet and a fluid outlet;
   b. a prefilter removably attached within the prefilter modular housing intermediate the fluid inlet and fluid outlet, for filtering selected particulate matter from fluid entering the prefilter modular housing;
   c. a modular casing detachably connected to the prefilter modular housing and defining an inlet in fluid communication with the fluid outlet of the prefilter modular housing when the modular casing and prefilter modular housing are connected and defining an outlet;
   d. means for rigidly connecting the prefilter modular housing on top of the modular casing;
   e. a filter attached within the modular casing for filtering selected particulate matter from fluid entering the modular casing;
   f. means, attached within the modular casing, for drawing a substantial volume of fluid through the prefilter modular housing inlet, prefilter, modular casing inlet, and filter; and
   g. means for facilitating transport of the modular casing, comprising:
      i. a handle connected to the modular casing at a first location; and
      ii. a support means connected to the modular casing at a second location remote from the first location.

2. A unit according to claim 1 in which the modular casing comprises:
   a. first and second filter modules in fluid communication; and
   b. means for connecting the first filter module to the second filter module.

3. A unit according to claim 1 in which the support means comprises a pedestal.

4. A unit according to claim 1 in which the prefilter comprises a reusable bag for filtering solid debris vacuumed from HVAC ductwork and thereby reducing the possibility of damage to the filter.

5. A unit according to claim 4 in which the filter comprises a HEPA filter.

6. A unit according to claim 5 in which the fluid drawing means comprises an electric motor driving a fan blower.

* * * * *

UNITED STATES PATENT AND TRADEMARK OFFICE

CERTIFICATE OF CORRECTION

PATENT NO. : 5,230,723

DATED : July 27, 1993

INVENTOR(S) : Terrell F. Travis, et al.

It is certified that error appears in the above-identified patent and that said Letters Patent is hereby corrected as shown below:

Column 1, line 61, delete the word "o" and insert --or-- therefor

Column 3, line 5, insert a period after the word "amperes"

Column 3, line 66, insert --7.-- following the second occurrence of the term "FIG."

Column 5, line 44, delete the word "us" and insert --use-- therefor

Column 5, line 57, delete the word "o" and insert --on-- therefor

Signed and Sealed this

Twelfth Day of April, 1994

Bruce Lehman

*Attest:*

BRUCE LEHMAN

*Commissioner of Patents and Trademarks*

*Attesting Officer*